US009851733B2

(12) United States Patent
Yoo et al.

(10) Patent No.: US 9,851,733 B2
(45) Date of Patent: Dec. 26, 2017

(54) VOLTAGE DROPPING APPARATUS, VOLTAGE SWITCHING APPARATUS, AND INTERNAL VOLTAGE SUPPLY APPARATUS USING THE SAME

(71) Applicant: SAMSUNG ELECTRO-MECHANICS CO., LTD., Suwon-Si (KR)

(72) Inventors: Hyun Hwan Yoo, Suwon-Si (KR); Jong Myeong Kim, Suwon-Si (KR); Yoo Hwan Kim, Suwon-Si (KR); Yoo Sam Na, Suwon-Si (KR); Dae Seok Jang, Suwon-Si (KR); Hyun Jin Yoo, Suwon-Si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 167 days.

(21) Appl. No.: 14/660,235

(22) Filed: Mar. 17, 2015

(65) Prior Publication Data

US 2016/0079843 A1 Mar. 17, 2016

(30) Foreign Application Priority Data

Sep. 15, 2014 (KR) ..... 10-2014-0121768

(51) Int. Cl.
*G05F 3/02* (2006.01)
*G05F 1/56* (2006.01)

(52) U.S. Cl.
CPC ..... *G05F 1/56* (2013.01)

(58) Field of Classification Search
CPC ..... H02M 1/08; H02M 1/081; H02M 1/082; H02M 1/083; H02M 1/084; H02M 1/0845; H02M 1/088; H02M 1/092; H02M 1/096; H03M 1/74; G05F 3/02
USPC ..... 327/543
See application file for complete search history.

(56) References Cited

U.S. PATENT DOCUMENTS 4,459,580 A * 7/1984 Furukawa ..... H03M 1/74 341/144
5,955,870 A * 9/1999 Nair ..... G05F 1/575 323/273
2006/0022742 A1 2/2006 Parris et al.
2010/0123693 A1* 5/2010 Utsunomiya ..... G09G 3/2011 345/205
2012/0200437 A1* 8/2012 Moue ..... H03M 3/386 341/110
2013/0314263 A1* 11/2013 Dix ..... H03M 1/06 341/154

(Continued)

FOREIGN PATENT DOCUMENTS

JP 2006-42304 A 2/2006

*Primary Examiner* — Lincoln Donovan
*Assistant Examiner* — Patrick Chen
(74) *Attorney, Agent, or Firm* — NSIP Law

(57) ABSTRACT

A voltage dropping apparatus may include: a voltage dropping unit receiving an input voltage, outputting the input voltage in a first mode, and dropping a level of the input voltage in a second mode; a voltage output unit connected to the voltage dropping unit, receiving and outputting the input voltage in the first mode, and receiving and outputting the dropped voltage in the second mode; and a control unit receiving a mode signal and controlling a mode change of the voltage dropping unit and the voltage output unit based on a value of the mode signal.

6 Claims, 7 Drawing Sheets

(56) References Cited

U.S. PATENT DOCUMENTS

2016/0142068 A1* 5/2016 Oshima ..... H03M 1/1038
341/118

* cited by examiner

VOLTAGE DROPPING APPARATUS, VOLTAGE SWITCHING APPARATUS, AND INTERNAL VOLTAGE SUPPLY APPARATUS USING THE SAME

CROSS-REFERENCE TO RELATED APPLICATION

This application claims priority to, and the benefit of Korean Patent Application No. 10-2014-0121768 filed on Sep. 15, 2014, with the Korean Intellectual Property Office, the disclosure of which is incorporated herein by reference.

BACKGROUND

The present inventive concept relates to a voltage dropping apparatus, a voltage switching apparatus, and an internal voltage supply apparatus using the same.

A device and a module used in a semiconductor integrated circuit (IC) have recently been minimized in terms of the sizes thereof. For example, a length of a channel in a semiconductor device and a thickness of a gate oxide have been decreased. Accordingly, a level of a breakdown voltage of the semiconductor device has been reduced.

However, a level of a required supply voltage is still higher than the level of the breakdown voltage of the semiconductor device by two times or more. Thus, there may arise an issue in that a semiconductor IC requires a protection circuit in order to prevent an internal semiconductor device from being damaged due to the breakdown voltage.

In a case in which a semiconductor IC uses a device having a high level of a breakdown voltage, such an issue as above may be solved. In this case, the use of an additional layer is necessary in a semiconductor process. Further, this results in an increase of the overall size of a semiconductor IC.

Patent Publication 1 below relates to a power gating circuit and a method thereof, which fails to disclose a solution to the issue detailed above.

RELATED ART DOCUMENT

Patent Document

Japanese Patent Laid-Open Publication No. 2006-042304

SUMMARY

An exemplary embodiment in the present inventive concept may provide a voltage dropping apparatus, a voltage switching apparatus, and an internal voltage supply apparatus using the same.

According to an exemplary embodiment in the present inventive concept, a voltage dropping apparatus may output an input voltage when operating in a first mode, and may drop a level of the input voltage and may output the input voltage having the dropped level when operating in a second mode. Here, the level of the input voltage may be dropped by a level equal to a level of a threshold voltage of a semiconductor device included in the voltage dropping apparatus.

According to another exemplary embodiment in the present inventive concept, a voltage switching apparatus may output a first voltage and a second voltage and may electrically connect the first voltage or the second voltage based on a gate signal. Here, whether to electrically connect the output voltage may be determined based on a signal input to a gate terminal of a semiconductor device included in the voltage switching apparatus.

According to another exemplary embodiment in the present inventive concept, an internal voltage supply apparatus may supply a first reference voltage as an internal voltage when operating in a first mode, and may drop a level of a source voltage and may simultaneously supply a second reference voltage as an internal voltage when operating in a second mode. Here, a control unit included in the internal voltage supply apparatus may control a difference between the level of the source voltage and a level of the internal voltage to maintain a level thereof equal to or lower than a level of a breakdown voltage of a semiconductor device.

BRIEF DESCRIPTION OF DRAWINGS

The above and other aspects, features and other advantages of the present inventive concept will be more clearly understood from the following detailed description taken in conjunction with the accompanying drawings, in which.

DETAILED DESCRIPTION

Figure 1:
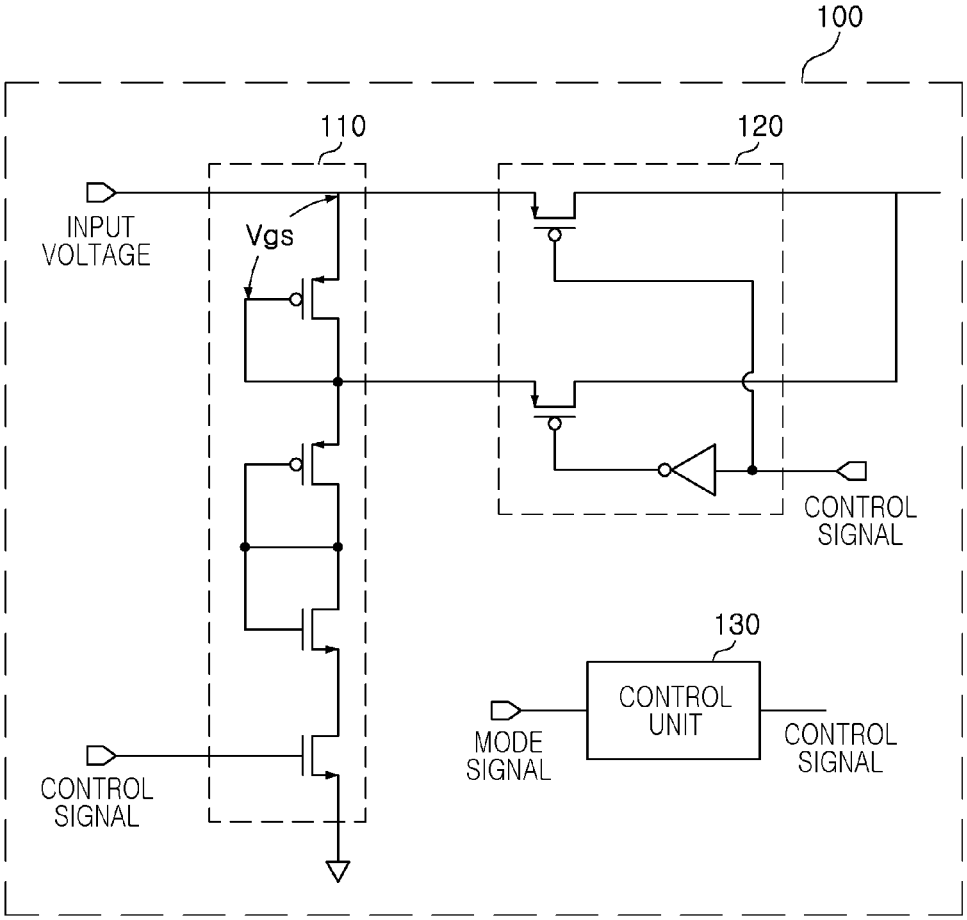
FIG. 1 is a view illustrating a voltage dropping apparatus according to an exemplary embodiment of the present inventive concept.

Exemplary embodiments of the present inventive concept will now be described in detail with reference to the accompanying drawings.

The inventive concept may, however, be exemplified in many different forms and should not be construed as being limited to the specific embodiments set forth herein. Rather, these embodiments are provided so that this disclosure will be thorough and complete, and will fully convey the scope of the inventive concept to those skilled in the art.

In the drawings, the shapes and dimensions of elements may be exaggerated for clarity, and the same reference numerals will be used throughout to designate the same or like elements.

FIG. 1 is a view illustrating a voltage dropping apparatus according to an exemplary embodiment of the present inventive concept.

Referring to FIG. 1, a voltage dropping apparatus 100 according to an exemplary embodiment of the present inventive concept may include a voltage dropping unit 110, a voltage output unit 120, and a control unit 130.

The voltage dropping unit 110 may output an input voltage in a first mode and may drop a level of the input voltage in a second mode. That is, a level of a voltage output from the voltage dropping unit 110 may vary based on a mode. Here, the mode of the voltage dropping unit 110 may be determined based on a value of a control signal received from the control unit 130.

In detail, the voltage dropping unit 110 may include a semiconductor device and may drop the level of the input voltage by using a threshold voltage of the semiconductor device. For example, the semiconductor device may be a field effect transistor (FET). In the second mode, the voltage dropping unit 110 may electrically connect the input voltage between a source terminal and a drain terminal of the semiconductor device. In a case in which a gate terminal and the drain terminal of the semiconductor device are connected, the electrically connected input voltage may be dropped by a level equal to a level of the threshold voltage of the semiconductor device. In a case in which the semiconductor device is a 3-terminal semiconductor device such as a bipolar junction transistor (BJT), the voltage dropping unit 110 may drop the level of the input voltage by using a threshold voltage of the 3-terminal semiconductor device in a manner similar to that described above. In addition, the semiconductor device may be a diode. In this case, the diode may be connected in forward bias. Here, the voltage dropping unit 110 may electrically connect the input voltage to the diode to thereby drop the level of the input voltage.

For example, the voltage dropping unit 110 may include a plurality of n-type metal-oxide-semiconductor (NMOS) transistors and a plurality of p-type metal-oxide-semiconductor (PMOS) transistors of which source terminals and drain terminals are connected to each other in series. Here, the number of the plurality of NMOS transistors and the plurality of PMOS transistors may be different based on the level of the input voltage and a level of a threshold voltage of a transistor. The voltage dropping unit 110 may allow currents to flow through the plurality of NMOS transistors and the plurality of PMOS transistors based on the mode, such that the level of the input voltage may be dropped. That is, the number of transistors may be determined to allow a multiplication of the level of the threshold voltage of the transistor and the number of transistors to be slightly lower than the level of the input voltage. Meanwhile, the number of the plurality of NMOS transistors and the number of the plurality of PMOS transistors may not need to be the same as each other. For example, the number of the plurality of PMOS transistors may be three, and the number of the plurality of NMOS transistors may be two.

In addition, the voltage dropping unit 110 may receive a control signal from the control unit 130 through a gate terminal of the NMOS transistor and may drop the level of the input voltage by using a threshold voltage of the PMOS transistor. In a case in which a value of the control signal is increased, a level of a voltage between the gate terminal and the source terminal of the NMOS transistor included in the voltage dropping unit 110 may be increased. Accordingly, currents may flow between the drain terminal and the source terminal of the NMOS transistor. Here, currents may flow through all of the transistors included in the voltage dropping unit 110 and connected in series. Through this, the PMOS transistor included in the voltage dropping unit 110 may drop the level of the input voltage.

The voltage output unit 120 may be connected to the voltage dropping unit 110, may output the input voltage output from the voltage dropping unit 110 in the first mode, and may output a voltage having a level dropped in the voltage dropping unit 110 in the second mode.

In detail, the voltage output unit 120 may be connected to a source terminal of an uppermost PMOS transistor of the plurality of PMOS transistors included in the voltage dropping unit 110 and may output the input voltage output from the voltage dropping unit 110. The voltage output unit 120 may be connected to a drain terminal of a lowermost PMOS transistor of the plurality of PMOS transistors included in the voltage dropping unit 110 and may output the voltage having the level dropped in the voltage dropping unit 110. Here, the level of the input voltage may be dropped by a level equal to a multiplication of the number of the plurality of PMOS transistors included in the voltage dropping unit 110 and a level of the threshold voltage of the plurality of PMOS transistors.

In addition, the voltage output unit 120 may include a first semiconductor switch outputting the input voltage electrically connected in the voltage dropping unit 110 and a second semiconductor switch outputting the voltage having the level dropped in the voltage dropping unit 110. For example, the first semiconductor switch and the second semiconductor switch may be FETs. That is, voltages may be electrically connected between a drain terminal and a source terminal of the semiconductor switch. Here, whether to electrically connect the voltages may be determined based on a level of a voltage of a gate terminal of the semiconductor switch.

Further, the voltage output unit 120 may receive control signals from the control unit 130 through gate terminals of the first semiconductor switch and the second semiconductor switch and may be controlled to allow the first semiconductor switch or the second semiconductor switch to be in an ON state based on the control signals. For example, an inverter may be included between the gate terminal of the semiconductor switch and a node receiving the control signal. Here, a control signal that does not pass through the inverter may be input to the gate terminal of the first semiconductor switch, and a control signal that passes through the inverter may be input to the gate terminal of the second semiconductor switch. Thus, when the first semiconductor switch electrically connects voltages, the second semiconductor switch may block an electrical connection of voltages. Likewise, when the second semiconductor switch electrically connects voltages, the first semiconductor switch may block an electrical connection of voltages.

The control unit 130 may receive a mode signal and may control a change of modes in the voltage dropping unit 110 and the voltage output unit 120 based on a value of the mode signal. For example, the control unit 130 may control the change of modes by outputting a control signal. Meanwhile, the mode signal may be a pulse signal, a sinusoidal signal, a signal having a predetermined value, or the like.

In addition, the control unit 130 may control a value of the control signal. Accordingly, the voltage dropping unit 110 may determine the level of the voltage to be dropped based on the value of the control signal. For example, in a case in which the control signal is input to the gate terminal of the NMOS transistor included in the voltage dropping unit 110, currents flowing through the transistors included in the voltage dropping unit 110 may be increased. Accordingly, a difference in voltage levels between the gate terminal and the source terminal of the transistors may be increased. Here, a level equal to the dropped level of the input voltage may correspond to the difference in voltage levels between the gate terminal and the source terminal of the transistors. Thus, as the value of the control signal is increased, the voltage dropping unit 110 may drop the level of the input voltage. Meanwhile, in a case in which the control signal is input to the gate terminal of the PMOS transistor included in the voltage dropping unit 110, as the value of the control signal is increased, the voltage dropping unit 110 may drop the level of the input voltage.

Figure 2:
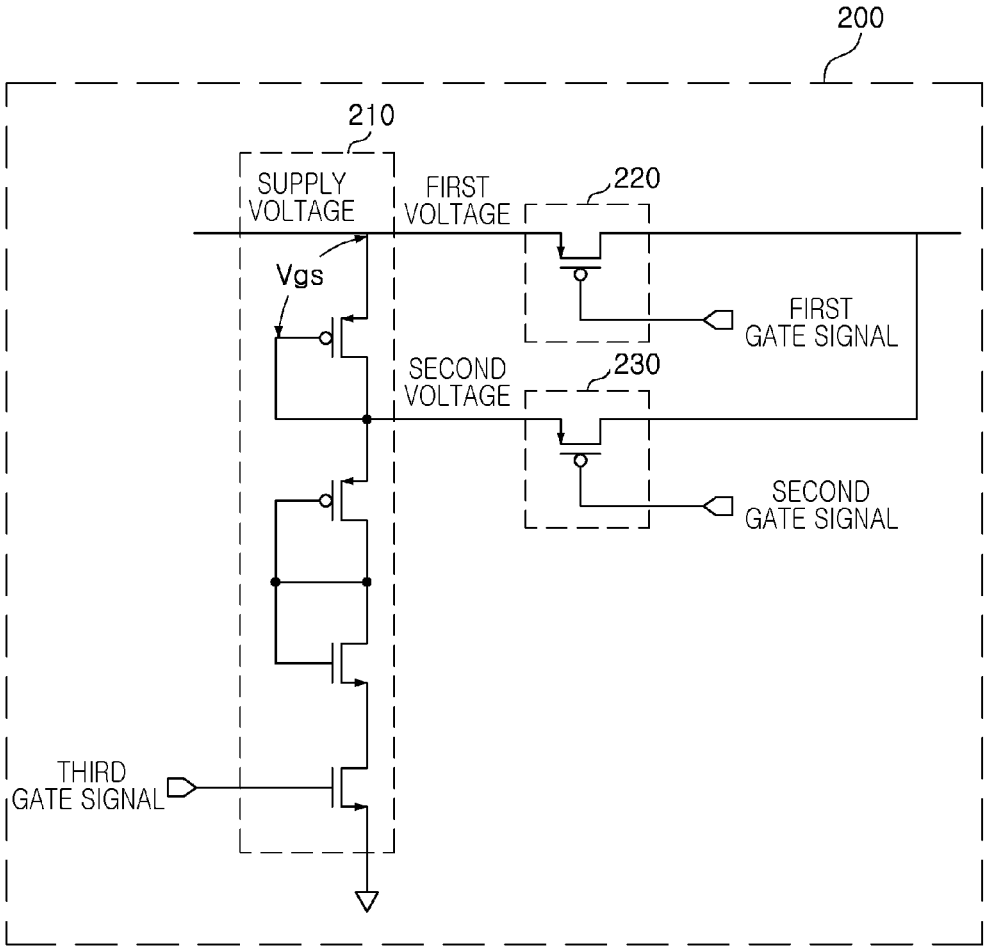
FIG. 2 is a view illustrating a voltage switching apparatus according to an exemplary embodiment of the present inventive concept.

FIG. 2 is a view illustrating a voltage switching apparatus according to an exemplary embodiment of the present inventive concept.

Referring to FIG. 2, a voltage switching apparatus 200 according to an exemplary embodiment of the present inventive concept may include a voltage output unit 210, a first switch unit 220, and a second switch unit 230.

Hereinafter, a configuration of the voltage switching apparatus 200 according to the exemplary embodiment of the present inventive concept will be described. A description identical to or corresponding to the configuration of the voltage dropping apparatus 100 according to the exemplary embodiment of the present inventive concept and the detailed description thereof provided with reference to FIG. 1 will be omitted.

The voltage output unit 210 may output a first voltage and a second voltage having a level lower than a level of the first voltage. For example, the first voltage may be a supply voltage.

In addition, the voltage output unit 210 may operate based on a third gate signal and may control a difference between the level of the first voltage and the level of the second voltage based on a value of the third gate signal. Accordingly, the voltage output unit 210 may output voltages having various levels.

For example, the voltage output unit 210 may include a plurality of NMOS transistors and a plurality of PMOS transistors connected to each other in series. The voltage output unit 210 may receive the third gate signal through a gate terminal of the NMOS transistor, and may output the second voltage having the level lower than the level of the first voltage by using a threshold voltage of the PMOS transistor.

The first switch unit 220 may be connected to the voltage output unit 210 to operate based on a first gate signal and may control an electrical connection of the first voltage based on a value of the first gate signal. For example, the first switch unit 220 may be connected to a source terminal of an uppermost PMOS transistor of the plurality of PMOS transistors included in the voltage output unit 210 and may electrically connect the first voltage.

The second switch unit 230 may be connected to the voltage output unit 210 to operate based on a second gate signal and may control an electrical connection of the second voltage based on a value of the second gate signal. For example, the second switch unit 230 may be connected to a drain terminal of a lowermost PMOS transistor of the plurality of PMOS transistors included in the voltage output unit 210 and may electrically connect the second voltage.

Further, the first switch unit 220 and the second switch unit 230 may include a second semiconductor switch electrically connecting the second voltage. Here, the second switch unit 230 may block the electrical connection of the second voltage in a case in which the first switch unit 220 electrically connects the first voltage, and may electrically connect the second voltage in a case in which the first switch unit 220 blocks the electrical connection of the first voltage.

Figure 3:
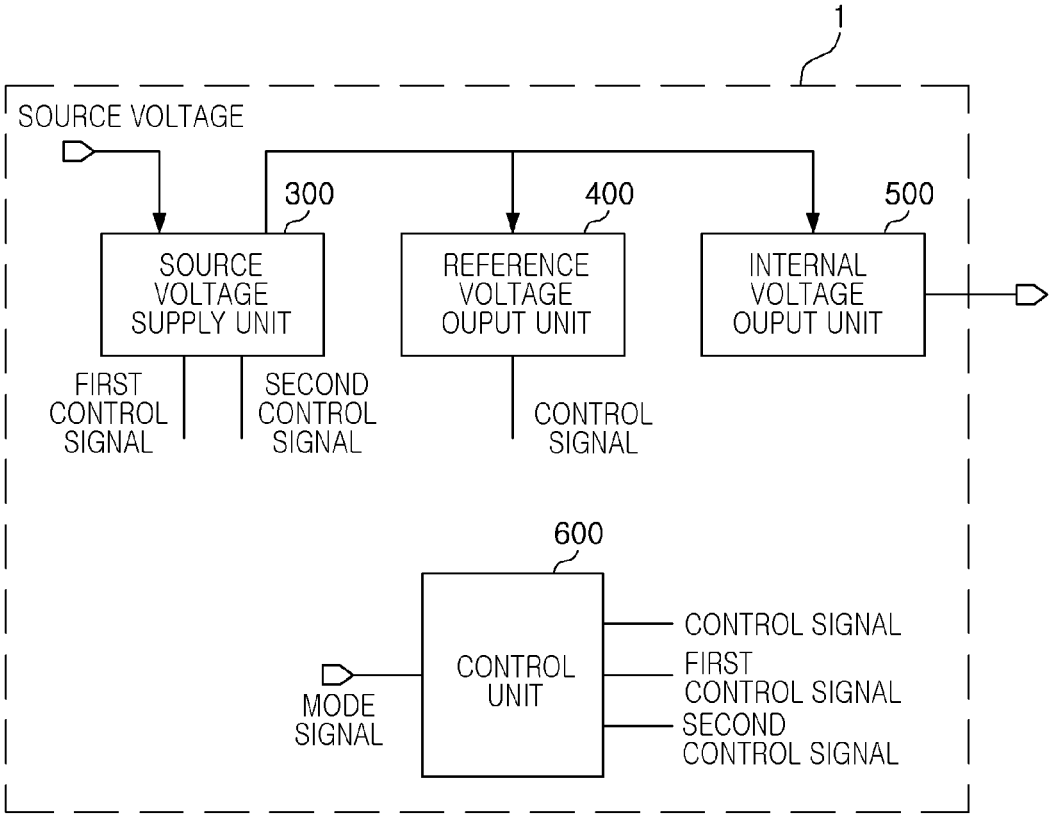
FIG. 3 is a view illustrating an internal voltage supply apparatus according to an exemplary embodiment of the present inventive concept.

FIG. 3 is a view illustrating an internal voltage supply apparatus according to an exemplary embodiment of the present inventive concept.

Referring to FIG. 3, an internal voltage supply apparatus 1 according to an exemplary embodiment of the present inventive concept may include a source voltage supply unit 300, a reference voltage output unit 400, an internal voltage output unit 500, and a control unit 600.

Meanwhile, the internal voltage supply apparatus 1 may be provided as an exemplary embodiment to which the above-described voltage dropping apparatus 100 and the voltage switching apparatus 200 are applied. That is, the application of the voltage dropping apparatus 100 and the voltage switching apparatus 200 may not be limited to the internal voltage supply apparatus 1.

The internal voltage supply apparatus 1 may supply an internal voltage to a semiconductor integrated circuit (IC) (not illustrated) through the internal voltage output unit 500. For example, the semiconductor IC may receive a supply voltage having a level considerably higher than a level of a breakdown voltage of a semiconductor device included within the semiconductor IC. Accordingly, by receiving the internal voltage supplied from the internal voltage supply apparatus 1, the semiconductor device included in the semiconductor IC may be protected from a breakdown.

In addition, the internal voltage supply apparatus 1 may drop a level of the internal voltage supplied to the semiconductor IC (not illustrated) through the reference voltage output unit 400. That is, in order to reduce a total amount of power consumed in the semiconductor IC (not illustrated), the internal voltage supply apparatus 1 may drop the level of the internal voltage.

However, in a case in which the level of the internal voltage is dropped by the reference voltage output unit 400, a voltage having a high level may be applied to the internal voltage output unit 500. Accordingly, the semiconductor device included in the internal voltage output unit 500 may be damaged due to a breakdown. In order to prevent such damage, the source voltage supply unit 300 and the control unit 600 may reduce the level of the voltage applied to the internal voltage output unit 500.

Hereinafter, each component included in the internal voltage supply apparatus 1 will be described.

The source voltage supply unit 300 may supply a source voltage in a first mode, and may drop a level of the source voltage and may supply the source voltage having the dropped level in a second mode. Here, the mode of the source voltage supply unit 300 may be changed from the first mode to the second mode such that a voltage having a high level may not be applied to the internal voltage output unit 500. A detailed description of the source voltage supply unit 300 will be provided in detail with reference to FIG. 4 later.

The reference voltage output unit 400 may output a first reference voltage in the first mode and may output a second reference voltage having a level lower than a level of the first reference voltage in the second mode. Here, in order to reduce a total amount of power consumed in the entire internal voltage supply apparatus 1 and the semiconductor IC to which the internal voltage is supplied, the mode of the reference voltage output unit 400 may be changed from the first mode to the second mode.

For example, the reference voltage output unit 400 may include a band gap reference. In a case in which the band gap reference is to be included in the reference voltage output unit 400, the reference voltage output unit 400 may output a voltage having a predetermined level, irrespective of external conditions and a degree of precision in a process of a circuit.

In addition, the reference voltage output unit 400 may receive a control signal from the control unit 600. Here, the reference voltage output unit 400 may output the first reference voltage or the second reference voltage based on a value of the control signal. For example, the reference voltage output unit 400 may include an inverter therein to switch voltages. Meanwhile, the first reference voltage and the second reference voltage may be output based on two band gap references, and may be output based on a single band gap reference and connection to ground. That is, the second reference voltage may include 0 volts (V).

The internal voltage output unit 500 may be connected to the reference voltage output unit 400 and may output the internal voltage based on the level of the reference voltage output from the reference voltage output unit 400. For example, the internal voltage output unit 500 may be a low drop out (LDO) circuit. That is, in a case in which the level of the voltage supplied from the source voltage supply unit 300 is higher than the level of the reference voltage, the internal voltage output unit 500 may output an internal voltage having a predetermined level, irrespective of the level of the voltage supplied from the source voltage supply unit 300. A detailed description of the internal voltage output unit 500 will be described with reference to FIG. 5 later.

The control unit 600 may receive a mode signal and may control modes of the source voltage supply unit 300 and the reference voltage output unit 400 based on a value of the mode signal.

In addition, the control unit 600 may output a first control signal and a second control signal based on the value of the mode signal. Here, the first control signal and the second control signal may be used to control the mode of the source voltage supply unit 300.

In addition, the control unit 600 may change the mode of the reference voltage output unit 400 from the first mode to the second mode subsequently to changing the mode of the source voltage supply unit 300 from the first mode to the second mode, and may change the mode of the source voltage supply unit 300 from the second mode to the first mode subsequently to changing the mode of the reference voltage output unit 400 from the second mode to the first mode. For example, in a case in which the control unit 600 changes the mode of the source voltage supply unit 300 from the first mode to the second mode subsequently to changing the mode of the reference voltage output unit 400 from the first mode to the second mode, a large difference in voltage levels may be momentarily generated between internal nodes of the internal voltage output unit 500. Here, the semiconductor device included in the internal voltage output unit 500 may be damaged since a voltage having a level higher than the level of the breakdown voltage is applied to the semiconductor device. Thus, the control unit 600 may sequentially control the modes of the source voltage supply unit 300 and the reference voltage output unit 400, thereby preventing the internal voltage output unit 500 from being damaged.

Figure 4:
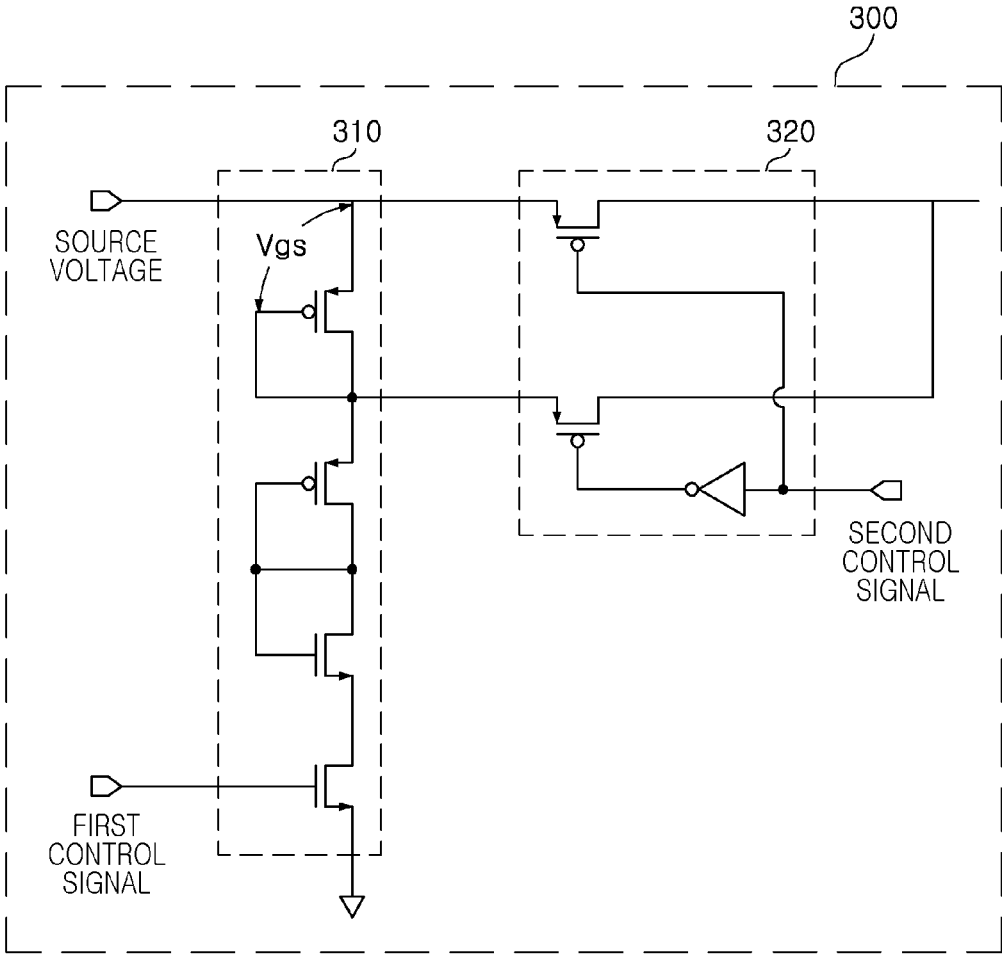
FIG. 4 is a view illustrating a source voltage supply unit included in an internal voltage supply apparatus.

FIG. 4 is a view illustrating a source voltage supply unit included in an internal voltage supply apparatus.

Referring to FIG. 4, the source voltage supply unit 300 included in the internal voltage supply apparatus 1 may include a voltage dropping unit 310 and a voltage output unit 320.

Hereinafter, a configuration of the source voltage supply unit 300 included in the internal voltage supply apparatus 1 will be described. The source voltage supply unit 300 may be replaced by the voltage dropping apparatus 100 and the voltage switching apparatus 200 described above. Thus, a description identical to or corresponding to the configurations of the voltage dropping apparatus 100 and the voltage switching apparatus 200 and the detailed descriptions thereof provided with reference to FIGS. 1 and 2 will be omitted.

The voltage dropping unit 310 may electrically connect a source voltage in a first mode and may drop a level of the source voltage in a second mode.

In addition, the voltage dropping unit 310 may include a plurality of PMOS transistors connected to each other in series and may drop the level of the source voltage by using a threshold voltage of at least one of the plurality of PMOS transistors.

In addition, the voltage dropping unit 310 may receive the first control signal and may determine the dropped level of the voltage based on a value of the first control signal.

The voltage output unit 320 may be connected to the voltage dropping unit 310 and may output the source voltage electrically connected in the voltage dropping unit 310 in the first mode, and may output the voltage having the level dropped in the voltage dropping unit 310 in the second mode.

In addition, the voltage output unit 320 may be connected to a source terminal of an uppermost PMOS transistor of the plurality of PMOS transistors included in the voltage dropping unit 310 and may output the electrically connected source voltage. Further, the voltage output unit 320 may be connected to a drain terminal of a lowermost PMOS transistor of the plurality of PMOS transistors included in the voltage dropping unit 310 and may output the voltage having the dropped level.

In addition, the voltage output unit 320 may include a first semiconductor switch outputting the source voltage electrically connected in the voltage dropping unit 310 and a second semiconductor switch outputting the voltage having the level dropped in the voltage dropping unit 310. Further, the voltage output unit 320 may receive the second control signal and may be controlled to allow the first semiconductor switch or the second semiconductor switch to be in an ON state based on a value of the second control signal.

Figure 5:
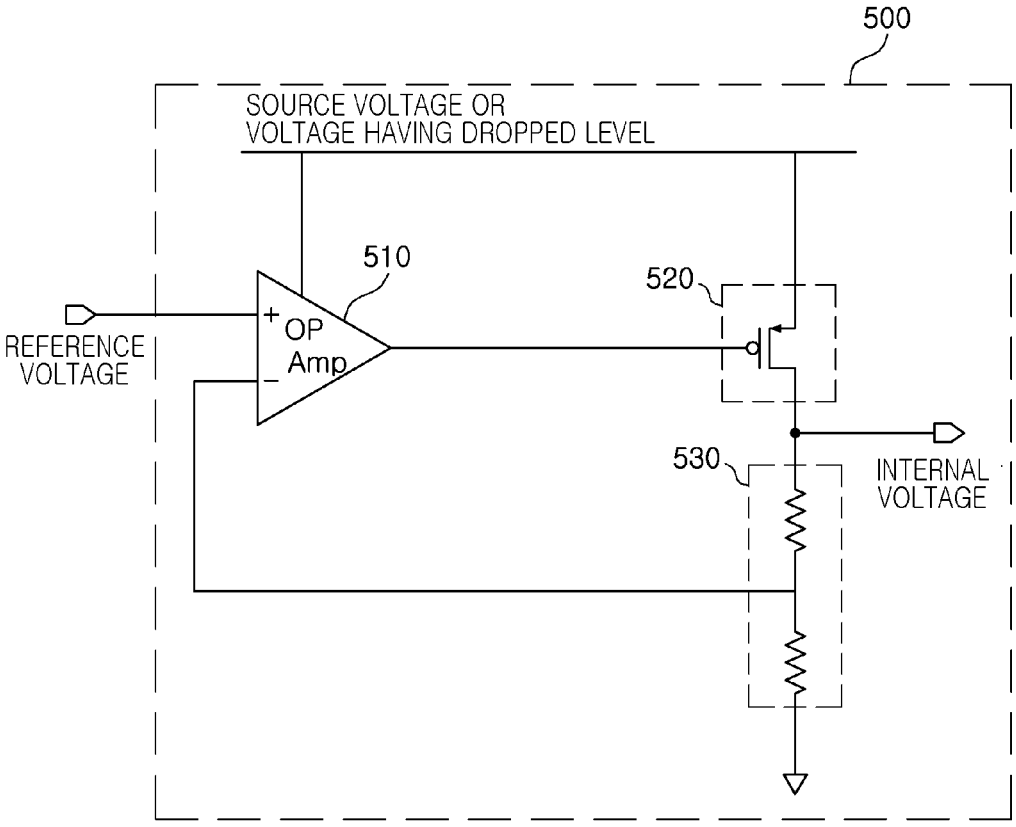
FIG. 5 is a view illustrating an internal voltage output unit included in an internal voltage supply apparatus.

FIG. 5 is a view illustrating an internal voltage output unit included in an internal voltage supply apparatus.

Referring to FIG. 5, the internal voltage output unit 500 included in the internal voltage supply apparatus 1 may include an operation amplifier 510, a PMOS transistor unit 520, and a voltage distribution unit 530.

The operation amplifier 510 may receive a reference voltage from the reference voltage output unit 400 and may output the reference voltage.

A gate terminal of the PMOS transistor unit 520 may receive the reference voltage from the operation amplifier 510, a source terminal of the PMOS transistor unit 520 may receive a source voltage or a voltage having a dropped level from the source voltage supply unit 300, and a drain terminal of the PMOS transistor unit 520 may be connected to an input terminal of the operation amplifier 510. Through a connection structure between the PMOS transistor unit 520 and the operation amplifier 510, the internal voltage output unit 500 my output an internal voltage having a predetermined level, irrespective of the level of the voltage supplied from the source voltage supply unit 300.

The voltage distribution unit 530 may adjust a level of the internal voltage output to the drain terminal of the PMOS transistor unit 520 based on the reference voltage output from the reference voltage output unit 400. For example, the voltage distribution unit 530 may adjust the level of the internal voltage by using a plurality of resistors.

Figure 6:
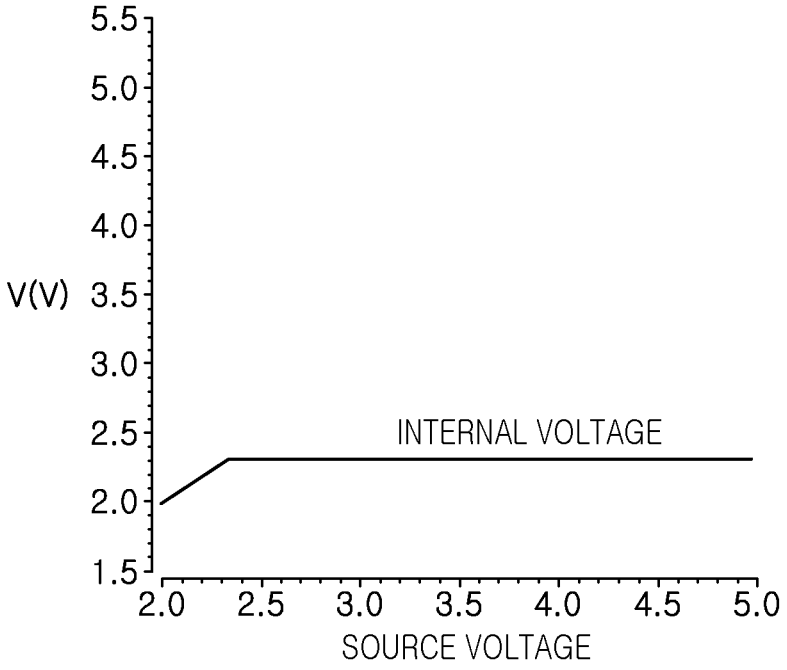
FIG. 6 is graphs illustrating a level of an internal voltage and a level of current consumption with respect to a level of a source voltage in a case in which an internal voltage supply apparatus operates in a first mode.
Figure 6:
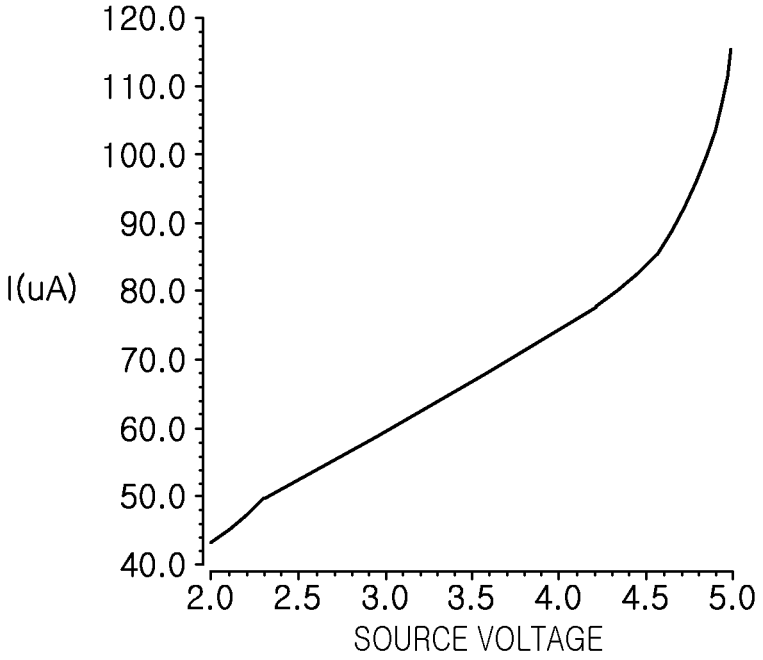

FIG. 6 is graphs illustrating a level of an internal voltage and a level of current consumption with respect to a level of a source voltage in a case in which an internal voltage supply apparatus operates in a first mode.

Referring to FIG. 6, a level of an internal voltage with respect to a level of a source voltage is illustrated in the upper graph. For example, in a case in which a first reference voltage is 2.4V, even in a case in which the level of the source voltage is higher than 2.4V, the level of the internal voltage may be constant to be about 2.4V.

Referring to FIG. 6, a level of a total current with respect to the level of the source voltage is illustrated in the lower graph. For example, in a case in which the level of the source voltage is 4.8V, the level of the total current may be about 96 microamperes (μA).

Figure 7:
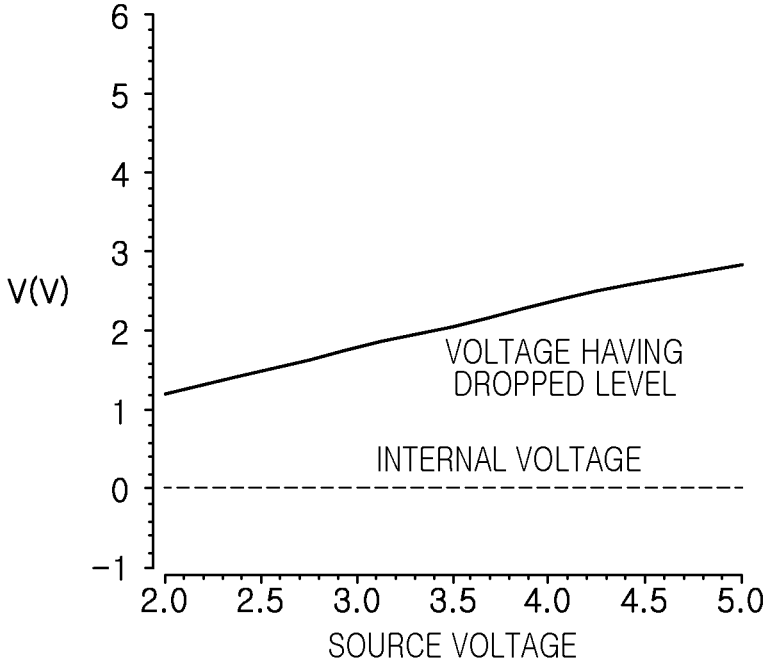
FIG. 7 is graphs illustrating a level of an internal voltage and a level of current consumption with respect to a level of a source voltage in a case in which an internal voltage supply apparatus operates in a second mode.
Figure 7:
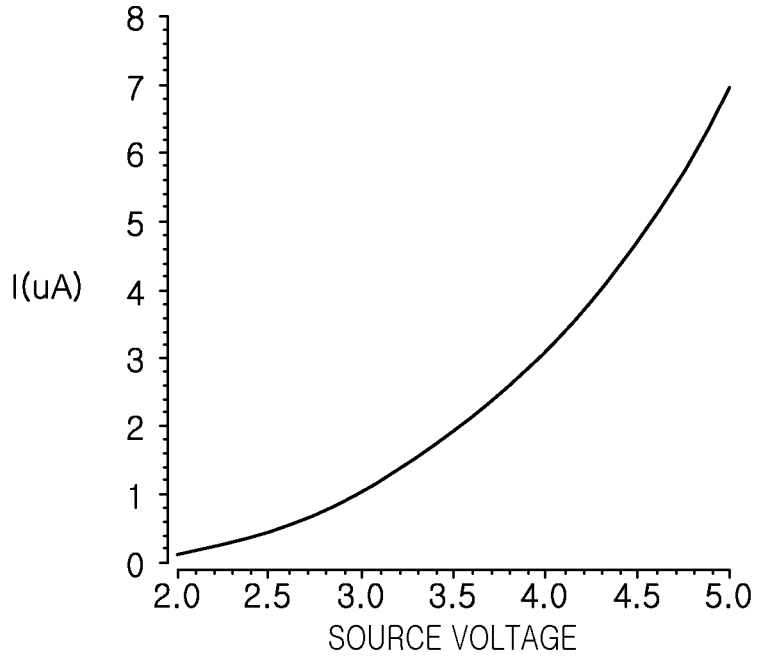

FIG. 7 is graphs illustrating a level of an internal voltage and a level of current consumption with respect to a level of a source voltage in a case in which an internal voltage supply apparatus operates in a second mode.

Referring to FIG. 7, a level of an internal voltage and a dropped level of a voltage with respect to a level of a source voltage are illustrated in the upper graph. For example, in a case in which a second reference voltage is 0V, the level of the internal voltage may be constant to be about 0V. In addition, in a case in which the level of the source voltage is 4.8V, the dropped level of the voltage may be about 2.8V. That is, in a case in which the internal voltage supply apparatus 1 operates in the second mode, a voltage having a level of 2.8V other than 4.8V may be applied to the internal voltage output unit 500. Thus, in a case in which the internal voltage supply apparatus 1 supplies a relatively low level of a voltage, a breakdown of the semiconductor device included in the internal voltage output unit 500 may be prevented.

Referring to FIG. 7, a level of a total current with respect to the level of the source voltage is illustrated in the lower graph. For example, in the case in which the level of the source voltage is 4.8V, the level of the total current may be about 6 μA. That is, the level of the total current may be substantially reduced in the case in which the internal voltage supply apparatus 1 operates in the second mode, as compared to a case in which the internal voltage supply apparatus 1 operates in the first mode.

As set forth above, according to exemplary embodiments of the present inventive concept, a voltage having a level lower than a level of a supply voltage may be output through voltage dropping or voltage switching, and thus the internal voltage supply apparatus using the voltage dropping or voltage switching may stably supply voltages having various levels.

Although the semiconductor device having a relatively low level of a breakdown voltage is included in the internal voltage supply apparatus and the semiconductor IC, the semiconductor device may be protected from damage caused by a breakdown.

While exemplary embodiments have been shown and described above, it will be apparent to those skilled in the art that modifications and variations could be made without departing from the scope of the invention as defined by the appended claims.

What is claimed is:

1. A voltage dropping apparatus comprising:

a voltage dropping unit comprising transistors of opposite polarities connected in series with one another and configured to receive an input voltage, output the input voltage in a first mode, and drop a level of the input voltage in a second mode by using a threshold voltage of one of the transistors;

a voltage output unit connected to the voltage dropping unit, and configured to receive and output the input voltage in the first mode, and receive and output the dropped voltage in the second mode; and a control unit configured to receive a mode signal and control a mode change of the voltage dropping unit and the voltage output unit based on a value of the mode signal, wherein the transistors include n-type metal-oxide-semiconductor (NMOS) transistors of which source terminals and drain terminals are connected to each other in series and p-type metal-oxide-semiconductor (PMOS) transistors of which source terminals and drain terminals are connected to each other in series, and the voltage dropping unit receives a control signal from the control unit through a gate terminal of one of the NMOS transistors and drops the level of the input voltage by using a threshold voltage of one of the PMOS transistors.

2. The voltage dropping apparatus of claim 1, wherein the control unit is configured to control a value of the control signal, and the voltage dropping unit is configured to determine the dropped level of the voltage based on the value of the control signal.

3. The voltage dropping apparatus of claim 1, wherein the voltage output unit is connected to a source terminal of an uppermost PMOS transistor of PMOS transistors to output an electrically connected input voltage, and is connected to a drain terminal of a lowermost PMOS transistor of PMOS transistors to output the voltage having the dropped level.

4. The voltage dropping apparatus of claim 1, wherein the voltage output unit includes a first semiconductor switch outputting the input voltage electrically connected in the voltage dropping unit and a second semiconductor switch outputting the voltage having the level dropped in the voltage dropping unit, and the voltage output unit receives a control signal from the control unit through gate terminals of the first semiconductor switch and the second semiconductor switch, and is controlled to allow the first semiconductor switch or the second semiconductor switch to be in an ON state based on the control signal.

5. The voltage dropping apparatus of claim 1, wherein the voltage dropping unit is configured to, in the second mode, drop the input voltage by a level equal to a mathematical function of a number of transistors with a same polarity included in the voltage dropping unit and a level of a threshold voltage of the transistors with the same polarity.

6. The voltage dropping apparatus of claim 1, wherein the input voltage is higher than a product of a threshold voltage of a transistor in the voltage dropping apparatus and a number of transistors in the voltage dropping apparatus, and a number of NMOS transistors is not equal to a number of PMOS transistors.

* * * * *